US011639278B2

(12) United States Patent
Miyagi

(10) Patent No.: US 11,639,278 B2
(45) Date of Patent: May 2, 2023

(54) MEDIA FEEDING APPARATUS AND IMAGE READING APPARATUS

(71) Applicant: SEIKO EPSON CORPORATION, Tokyo (JP)

(72) Inventor: Yohei Miyagi, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/128,706

(22) Filed: Dec. 21, 2020

(65) Prior Publication Data

US 2021/0188582 A1 Jun. 24, 2021

(30) Foreign Application Priority Data

Dec. 23, 2019 (JP) ..... JP2019-231087

(51) Int. Cl.
*B65H 3/06* (2006.01)
*B65H 7/18* (2006.01)

(52) U.S. Cl.
CPC ..... *B65H 7/18* (2013.01); *B65H 3/063* (2013.01); *B65H 3/0607* (2013.01); *B65H 3/0669* (2013.01); *B65H 3/0676* (2013.01)

(58) Field of Classification Search
CPC ..... B65H 7/18; B65H 3/0607; B65H 3/063; B65H 3/0669; B65H 3/0676
See application file for complete search history.

(56) References Cited

U.S. PATENT DOCUMENTS 3,870,294 A * 3/1975 Donner ..... G06K 13/10 271/119
5,014,973 A * 5/1991 Markert ..... B65H 1/06 271/100
5,219,157 A * 6/1993 Takahashi ..... B65H 3/122 271/118
5,465,949 A * 11/1995 Yamada ..... B65H 3/54 271/3.13
5,906,366 A * 5/1999 Chang ..... B65H 3/56 221/231
2014/0084531 A1* 3/2014 Fukumoto ..... B65H 3/0684 271/10.1
2018/0032018 A1* 2/2018 Takatou ..... G03G 15/6502

FOREIGN PATENT DOCUMENTS

| | | |
|---|---|---|
| CN | 207301632 | 5/2018 |
| JP | 2008-019069 | 1/2008 |
| JP | 2018-016484 | 2/2018 |
| WO | 2019/073632 | 4/2019 |

* cited by examiner

*Primary Examiner* — Thomas A Morrison
(74) *Attorney, Agent, or Firm* — Workman Nydegger

(57) ABSTRACT

A media feeding apparatus includes a media mounting section, a first feed roller, a media pressing section for pressing media sheets against the first feed roller, and a pressing force adjuster for adjusting the pressing force of the media pressing section. The controller sets the pressing force of the media pressing section to first pressing force and drives the first feed roller and the second feed roller in a forward rotation direction, and in a case in which the first detector detects a passage of a leading edge of the media sheet and the second detector detects no passage of the leading edge of the media sheet after predetermined first set time has passed, the controller continues the rotation of the first feed roller and the second feed roller with second pressing force of the media pressing section greater than or equal to the first pressing force.

14 Claims, 6 Drawing Sheets

MEDIA FEEDING APPARATUS AND IMAGE READING APPARATUS

The present application is based on, and claims priority from JP Application Serial Number 2019-231087, filed Dec. 23, 2019, the disclosure of which is hereby incorporated by reference herein in its entirety.

BACKGROUND

1. Technical Field

The present disclosure relates to a media feeding apparatus for feeding media sheets and an image reading apparatus having the media feeding apparatus.

2. Related Art

Image reading apparatuses such as scanners and recording apparatuses such as printers are, for example, provided with a separation roller for separating media sheets and a feed roller that rotates in a media feeding direction, and the separation roller and the feed roller nip and separate the media sheets. For example, JP-A-2018-016484 discusses a structure that includes a pick roller disposed on an upstream of a feed roller and a separation roller, and a pressing section for pressing media sheets against the pick roller, and the pick roller feeds the media sheets toward the feed roller and the separation roller. In JP-A-2018-016484, the separation roller is referred to as a retard roller.

In the document feeding apparatus in JP-A-2018-016484, when a first detection section disposed on the upstream of the feed roller detects media sheets, the document feeding apparatus reduces the pressing force applied by the pressing section and reduces the rotation speed of the pick roller. After a predetermined period of time has passed, when no media sheet is detected by a second detection section disposed on the downstream of the feed roller, the document feeding apparatus determines that a jam has occurred. As described above, upon detecting the media sheets with the first detection section disposed on the upstream of the feed roller, the document transport apparatus reduces the pressing force applied by the pressing section and reduces the rotation speed of the pick roller, and thus the feeding force of the pick roller is reduced at the time. Accordingly, in particular, when a number of media sheets are mounted, large back tension exerted on the media sheets to be fed may cause the media sheets to stop when the feeding force of the pick roller is reduced and the media sheets cannot reach the feed roller. In such a case, the document feeding apparatus may determine that a jam has occurred.

SUMMARY

A media feeding apparatus according to an aspect of the present disclosure for solving the above-described problem includes a media mounting section on which a plurality of media sheets to be fed are to be mounted, a first feed roller disposed at a position where the first feed roller faces a lowermost media sheet of the media sheets mounted on the media mounting section, the first feed roller being configured to apply feeding force to the media sheets, a media pressing section configured to press the media sheets against the first feed roller, a pressing force adjuster configured to adjust the pressing force of the media pressing section for pressing the media sheets against the first feed roller, a second feed roller disposed on a downstream of the first feed roller in a media feeding direction, the second feed roller being configured to feed the media sheets fed by the first feed roller in the media feeding direction, a separation roller configured to nip and separate the media sheets with the second feed roller between the separation roller and the second feed roller, a first detector disposed on an upstream of the second feed roller in the media feeding direction, the first detector being configured to detect a passage of the media sheet, a second detector disposed on the downstream of the second feed roller in the media feeding direction, the second detector being configured to detect a passage of the media sheet, and a controller configured to control the pressing force adjuster and the feeding of the media sheets based on the results of the detection by the first detector and the second detector. The controller sets the pressing force of the media pressing section to first pressing force and drives the first feed roller and the second feed roller in a forward rotation direction, and in a first case in which the first detector detects a passage of a leading edge of the media sheet and the second detector detects no passage of the leading edge of the media sheet after predetermined first set time has passed, the controller continues the rotation of the first feed roller and the second feed roller with second pressing force of the media pressing section greater than or equal to the first pressing force.

A media feeding apparatus according to another aspect of the present disclosure for solving the above-described problem includes a media mounting section on which a plurality of media sheets to be fed are to be mounted, a tilt angle adjuster configured to adjust a tilt angle of the media mounting section, a first feed roller disposed at a position where the first feed roller faces a lowermost media sheet of the media sheets mounted on the media mounting section, the first feed roller being configured to apply feeding force to the media sheets, a media pressing section configured to press the media sheets against the first feed roller, a second feed roller disposed on a downstream of the first feed roller in a media feeding direction, the second feed roller being configured to feed the media sheets fed by the first feed roller in the media feeding direction, a separation roller configured to nip and separate the media sheets with the second feed roller between the separation roller and the second feed roller, a first detector disposed on an upstream of the second feed roller in the media feeding direction, the first detector being configured to detect a passage of the media sheet, a second detector disposed on the downstream of the second feed roller in the media feeding direction, the second detector being configured to detect a passage of the media sheet, and a controller configured to control the tilt angle adjuster and the feeding of the media sheets based on the results of the detection by the first detector and the second detector. The controller sets the tilt angle of the media mounting section to a first tilt angle and drives the first feed roller and the second feed roller in the forward rotation direction, and in a first case in which the first detector detects a passage of a leading edge of the media sheet and the second detector detects no passage of the leading edge of the media sheet after predetermined first set time has passed, the controller sets the tilt angle of the media mounting section from the first tilt angle to a second tilt angle that is greater than the first tilt angle and continues the rotation of the first feed roller and the second feed roller. In still another aspect of the present disclosure, an image reading apparatus includes a reader configured to read a surface of a media sheet, and the media feeding apparatus according to the first aspect.

DESCRIPTION OF EXEMPLARY EMBODIMENTS

Figure 1:
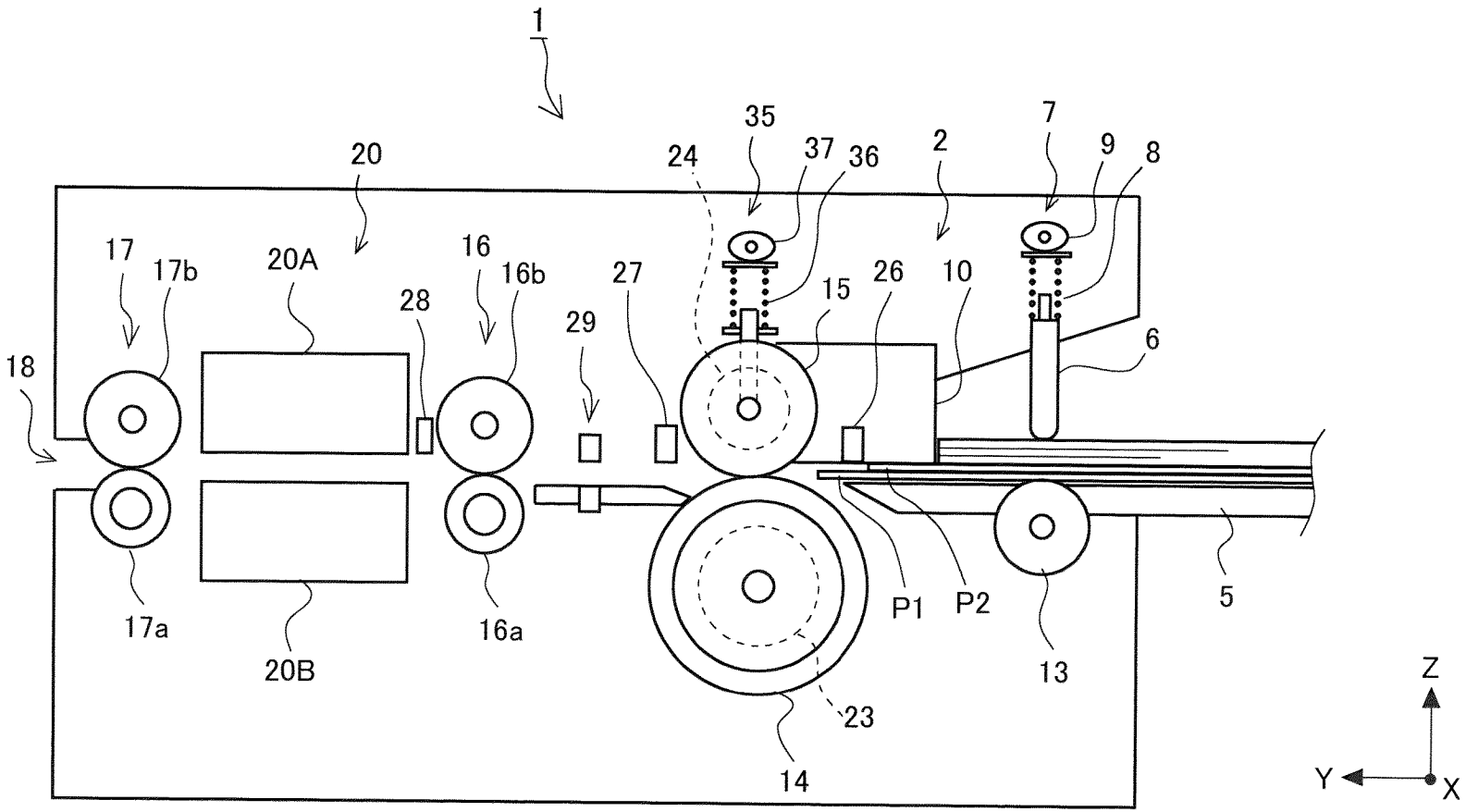
FIG. 1 is a side view of a document feeding path in a scanner according to an embodiment of the present disclosure.

Hereinafter, an overview of the present disclosure will be described. A media feeding apparatus according to an aspect of the present disclosure includes a media mounting section on which a plurality of media sheets to be fed are to be mounted, a first feed roller disposed at a position where the first feed roller faces a lowermost media sheet of the media sheets mounted on the media mounting section, the first feed roller being configured to apply feeding force to the media sheets, a media pressing section configured to press the media sheets against the first feed roller, a pressing force adjuster configured to adjust the pressing force of the media pressing section for pressing the media sheets against the first feed roller, a second feed roller disposed on a downstream of the first feed roller in a media feeding direction, the second feed roller being configured to feed downstream the media sheets fed by the first feed roller in the media feeding direction, a separation roller configured to nip and separate the media sheets with the second feed roller between the separation roller and the second feed roller, a first detector disposed on an upstream of the second feed roller in a media feeding direction, the first detector being configured to detect a passage of the media sheet, a second detector disposed on the downstream of the second feed roller in a media feeding direction, the second detector being configured to detect a passage of the media sheet, and a controller configured to control the pressing force adjuster and the feeding of the media sheets based on the results of the detection by the first detector and the second detector. The controller sets the pressing force of the media pressing section to first pressing force and drives the first feed roller and the second feed roller in a forward rotation direction, and in a first case in which the first detector detects a passage of a leading edge of the media sheet and the second detector detects no passage of the leading edge of the media sheet after predetermined first set time has passed, the controller continues the rotation of the first feed roller and the second feed roller with second pressing force of the media pressing section greater than or equal to the first pressing force.

According to the aspect, in the first case in which the first detector detects a passage of a leading edge of the media sheet and the second detector detects no passage of the leading edge of the media sheet after predetermined first set time has passed, the controller continues the rotation of the first feed roller and the second feed roller with the second pressing force of the media pressing section greater than or equal to the first pressing force. Accordingly, a decrease in the media feeding force of the first feed roller can be prevented or reduced, and it can be expected that the leading edge of the media sheet reaches the media detection position of the second detector.

According to a second aspect, in the first aspect, after the controller sets the pressing force of the media pressing section to the first pressing force and drives the first feed roller in the forward rotation direction, when the first detector detects no passage of the leading edge of the media sheet after predetermined second set time has passed, the controller may set the pressing force of the media pressing section to third pressing force greater than the first pressing force, and continue the rotation of the first feed roller.

According to the aspect, after the controller sets the pressing force of the media pressing section to the first pressing force and drives the first feed roller in the forward rotation direction, when the first detector detects no passage of the leading edge of the media sheet after predetermined second set time has passed, the controller sets the pressing force of the media pressing section to third pressing force greater than the first pressing force, and continues the rotation of the first feed roller. By increasing the media feeding force of the first feed roller, it can be expected that the leading edge of the media sheet reaches the media detection position of the first detector.

According to a third aspect, in the second aspect, after the controller sets the pressing force of the media pressing section to the third pressing force, when the first detector detects a passage of the leading edge of the media sheet within a predetermined third set time, the controller may change the pressing force from the third pressing force to the first pressing force, and when the first detector detects no passage of the leading edge of the media sheet after the predetermined third set time has passed, the controller may stop the first feed roller and the second feed roller and issue an alert.

According to the aspect, after the controller sets the pressing force of the media pressing section to the third pressing force, when the first detector detects a passage of the leading edge of the media sheet within a predetermined third set time, the controller changes the pressing force from the third pressing force to the first pressing force. Consequently, multi-sheet feeding of the media sheets due to an excessive pressing force can be prevented or reduced.

According to a fourth aspect, in any one of the first to third aspects, the media feeding apparatus may include a nipping force adjuster configured to adjust nipping force for nipping the media sheets between the separation roller and the second feed roller. In the first case in which the first detector detects a passage of a leading edge of the media sheet and the second detector detects no passage of the leading edge of the media sheet after predetermined first set time has passed, the controller may set the nipping force to second nipping force greater than the first nipping force applied when the feeding of the media sheet is started, and continue the rotation of the first feed roller and the second feed roller. The media feeding apparatus may include a tilt angle adjuster configured to adjust a tilt angle of the media mounting section, and the controller may control the tilt angle adjuster. The controller may set the tilt angle of the media mounting section to a first tilt angle and drive the first feed roller and the second feed roller in the forward rotation direction, and the controller, in the first case, may set the tilt angle of the media mounting section to a second tilt angle greater than the first tilt angle, and continue the rotation of the first feed roller and the second feed roller. The controller, in the first case, may increase the rotation speed of the second feed roller. The media feeding apparatus may include a regulator that is disposed on the downstream of the media pressing section in the media feeding direction and is configured to regulate the number of media sheets to be fed into the nip portion between the second feed roller and the separation roller, and a multi-sheet feed detector configured to detect multi-sheet feeding of the media sheets fed by the second feed roller. The controller may control the regulator, and the controller, when the multi-sheet feed detector detects multi-sheet feeding, may change the position of the regulator to the upstream.

According to the aspect, in the first case in which that the first detector detects a passage of a leading edge of the media sheet and the second detector detects no passage of the leading edge of the media sheet after a predetermined first set time has passed, the controller sets the nipping force to the second nipping force greater than the first nipping force applied when the feeding of the media sheet is started, and continues the rotation of the first feed roller and the second feed roller. By increasing the media feeding force of separation roller and the second feed roller, it can be expected that the leading edge of the media sheet reaches the media detection position of the second detector.

According to a fifth aspect, a media feeding apparatus includes a media mounting section on which a plurality of media sheets to be fed are to be mounted, a tilt angle adjuster configured to adjust a tilt angle of the media mounting section, a first feed roller disposed at a position where the first feed roller faces a lowermost media sheet of the media sheets mounted on the media mounting section, the first feed roller being configured to apply feeding force to the media sheets, a media pressing section configured to press the media sheets against the first feed roller, a second feed roller disposed on a downstream of the first feed roller in a media feeding direction, the second feed roller being configured to feed the media sheets fed by the first feed roller in the media feeding direction, a separation roller configured to nip and separate the media sheets with the second feed roller between the separation roller and the second feed roller, a first detector disposed on an upstream of the second feed roller in the media feeding direction, the first detector being configured to detect a passage of the media sheet, a second detector disposed on the downstream of the second feed roller in the media feeding direction, the second detector being configured to detect a passage of the media sheet, and a controller configured to control the tilt angle adjuster and the feeding of the media sheets based on the results of the detection by the first detector and the second detector. The controller sets the tilt angle of the media mounting section to a first tilt angle and drives the first feed roller and the second feed roller in the forward rotation direction, and in a first case in which the first detector detects a passage of a leading edge of the media sheet and the second detector detects no passage of the leading edge of the media sheet after predetermined first set time has passed, the controller sets the tilt angle of the media mounting section from the first tilt angle to a second tilt angle that is greater than the first tilt angle and continues the rotation of the first feed roller and the second feed roller.

According to the aspect, when the second detector detects no passage of the leading edge of the media sheet after a predetermined first set time has passed, the controller sets the tilt angle of the media mounting section from the first tilt angle to a second tilt angle greater than the first tilt angle and continues the rotation of the first feed roller and the second feed roller. By setting the tilt angle to the second tilt angle, a transport load that acts on the media sheets can be reduced, and it can be expected that the leading edge of the media sheet reaches the media detection position of the second detector.

An image reading apparatus according to a sixth aspect includes a reader configured to read a surface of a media sheet, and the media feeding apparatus according to any one of the first to fifth aspects. According to the aspect, in an image reading apparatus, any one of the effects in the above-described first to fifth aspects can be achieved.

Hereinafter, an embodiment of the present disclosure will be described. In the description below, as an example image reading apparatus, a scanner 1 that can read at least one side of a front side and a back side of a document, which is an example of media, will be described. The scanner 1 is a document scanner that reads a document while transporting the document with respect to a reader.

In an X-Y-Z coordinate system in the drawings, an X-axis direction denotes an apparatus width direction and also denotes a document width direction. A Y-axis direction denotes an apparatus depth direction and also denotes a direction along a horizontal direction. A Z-axis denotes a direction along a vertical direction.

In the following description, a direction (+Y direction) in which a document is transported may be referred to as "downstream" and an opposite direction (−Y direction) may be referred to as "upstream". The +Y direction denotes a document feeding direction. In FIG. 1, the scanner 1 includes a substantially linear document feeding path, and on a most upstream of the path, includes a document mounting section 5 on which a plurality of document sheets are mounted. In a document mounting area defined by the document mounting section 5, a feed roller 13 that is driven by a feed motor 52 (see FIG. 3) is disposed. The feed roller 13 is disposed at a position where the feed roller 13 faces a lowermost document of document sheets mounted on the document mounting section 5. In FIG. 1, a document P1 is a lowermost document of the document sheets mounted on the document mounting section 5, and a document P2 is a document on the document P1.

Above the feed roller 13, a document pressing section 6 that presses documents against the feed roller 13 is disposed. The document pressing section 6 is switched by a switching mechanism (not illustrated) between a state in FIG. 1 in which the document pressing section 6 is in contact with an uppermost document of the documents mounted on the document mounting section 5 and a state (not illustrated) in which the document pressing section 6 is separated from the uppermost document. The switching mechanism can be implemented with a solenoid (not illustrated) for switching a state between an energized state and a de-energized state under the control of a controller 50 (see FIG. 3).

While the document pressing section 6 presses the documents against the feed roller 13, the feed roller 13 that rotates in a forward direction, that is, in a counterclockwise direction in FIG. 1, applies a feeding force to the lowermost document P1 of the documents mounted on the document mounting section 5, and thereby the document P1 is fed downstream.

The document pressing section 6 is pressed against the feed roller 13 by a compression spring 8, which is an example pressing section. A rotatable eccentric cam 9 is disposed on the compression spring 8. As a phase of the eccentric cam 9 changes, the spring length of the compression spring 8 changes to adjust the pressing force of the document pressing section 6 for pressing the documents. The eccentric cam 9 receives the power of a motor (not illustrated) that is controlled by the controller 50 (see FIG.

3) and rotates. The motor, the eccentric cam 9, and the compression spring 8 function as a pressing force adjuster 7 for adjusting the pressing force of the document pressing section 6 for pressing documents against the feed roller 13.

Figure 2:
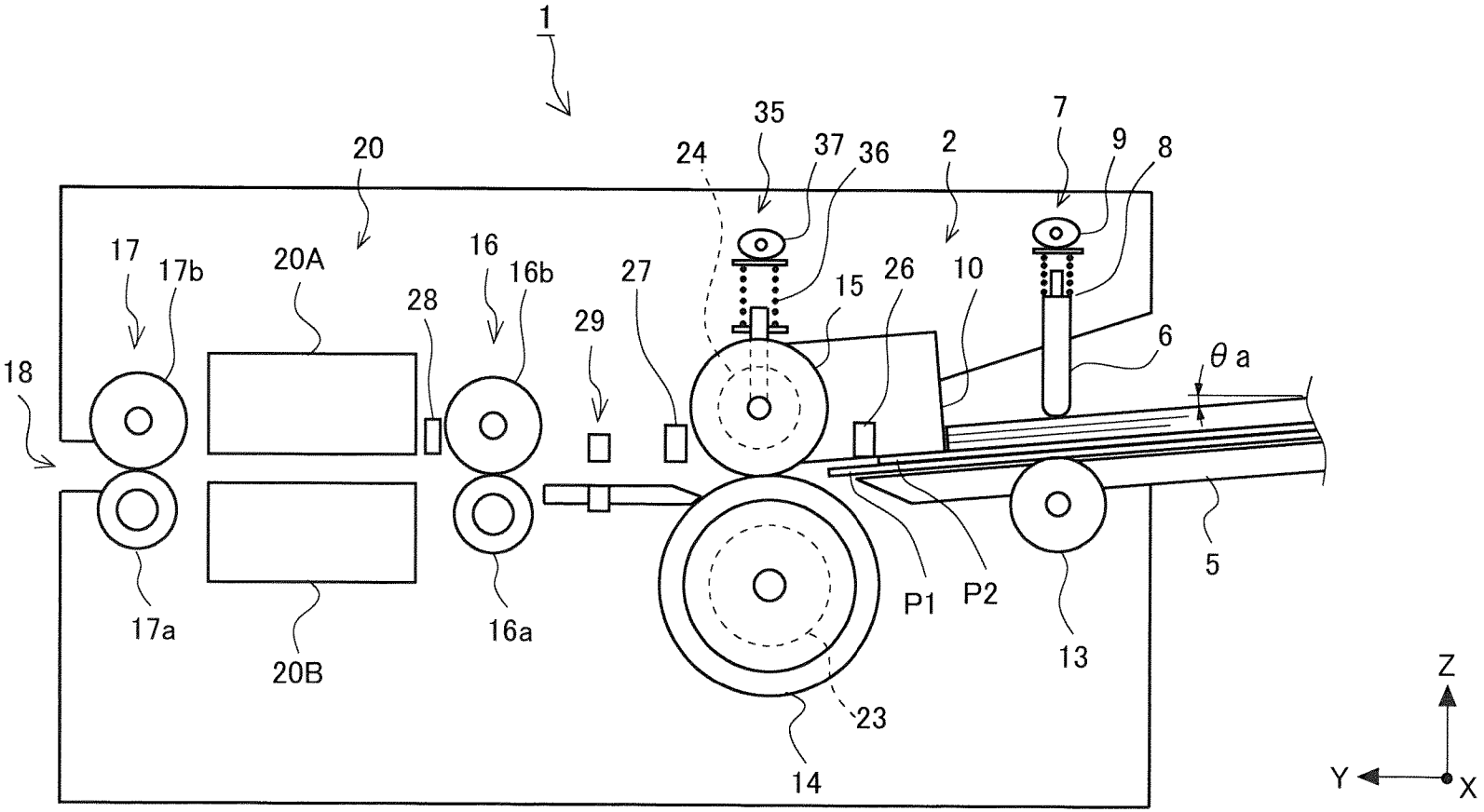
FIG. 2 is a side view of a document feeding path in a scanner according to an embodiment of the present disclosure.

On a downstream of the document pressing section 6, a space regulating section 10 is disposed. The space regulating section 10 regulates the number of document sheets to be fed to a document nip position, which will be described below, between a feed roller 14 and a separation roller 15. The document mounting section 5 includes a pivot shaft (not illustrated) near its end portion on the downstream, and the document mounting section 5 swings about the pivot shaft to change its position. The position of the document mounting section 5 is changed by a motor (not illustrated) under the control of the controller 50 (see FIG. 3). The document mounting section 5 is normally positioned at a horizontal position illustrated in FIG. 1, and documents that are mounted thereon are also in the horizontal position. The document mounting section 5 is tilted to a tilt position illustrated in FIG. 2 as necessary. In FIG. 2, an angle θa indicates a tilt angle of the mounted documents. The motor for changing the position of the document mounting section 5 functions as a tilt angle adjuster 40 (see FIG. 3).

On the downstream of the feed roller 13, the feed roller 14 that feeds documents downstream and the separation roller 15 that nips and separates documents with the feed roller 14 between the separation roller 15 and the feed roller 14 are disposed. To the feed roller 14, torque in a counterclockwise direction in FIG. 1, that is, torque in a direction in which documents are fed downstream is transmitted from the feed motor 52 (see FIG. 3) through an one way clutch 23. Since the torque is transmitted through the one way clutch 23, when the feed motor 52 (see FIG. 3) rotates in the reverse direction, the feed roller 14 does not rotate in the reverse direction. When the feed motor 52 is stopped, the feed roller 14 can come into contact with a document being transported and rotate in the forward rotation direction.

To the separation roller 15, rotation torque is transmitted from a separation motor 54 (see FIG. 3) through a torque limiter 24. From the separation motor 54, torque in a forward rotation direction (clockwise direction in FIG. 3) for feeding a document downstream with respect to the separation roller 15 or torque in a reverse direction (counterclockwise direction in FIG. 3) for returning a document upstream is transmitted.

When no document is provided or only one document sheet is provided between the feed roller 14 and the separation roller 15, rotation torque from the feed roller 14 that causes the separation roller 15 to rotate in the forward rotation direction exceeds limit torque of the torque limiter 24, resulting in the slippage in the torque limiter 24. As a result, regardless of the rotation torque from the separation motor 54, the separation roller 15 is driven to rotate in the forward rotation direction, that is, it idles. During a document feeding operation, basically, the separation motor 54 rotates in the reverse direction, that is, generates drive torque for rotating the separation roller 15 in the reverse direction.

In addition to a document to be fed, when a second document and subsequent documents are fed between the feed roller 14 and the separation roller 15, a slippage will occur between the documents, and then the separation roller 15 rotates in the reverse direction with the drive torque from the separation motor 54. This reverse rotation feeds back the second document and subsequent documents that are likely to be multi-fed to the upstream, that is, the multi-sheet feeding of the documents can be prevented. Accordingly, to increase the separating force produced by the separation roller 15 at the occurrence of multi-sheet feeding, the reverse rotation speed of the separation motor 54 may be increased.

The separation roller 15 is pressed against the feed roller 14 by a compression spring 36, which is an example pressing section. A rotatable eccentric cam 37 is disposed on the compression spring 36. As a phase of the eccentric cam 37 changes, the spring length of the compression spring 36 changes to adjust a nipping force for nipping documents between the separation roller 15 and the feed roller 14. The eccentric cam 37 receives the power of a motor (not illustrated) that is controlled by the controller 50 (see FIG. 3) and rotates. The motor, the eccentric cam 37, and the compression spring 36 function as a nipping force adjuster 35 for adjusting the nipping force for nipping documents between the separation roller 15 and the feed roller 14.

The above-described document mounting section 5, the feed roller 13, the document pressing section 6, the pressing force adjuster 7, the feed roller 14, the separation roller 15, and the nipping force adjuster 35 are a part of a document feeder 2 for feeding documents. Furthermore, the controller 50, the feed motor 52, and the separation motor 54, which will be described below, are also a part of the document feeder 2. From another point of view, the document feeder 2 can be regarded as an apparatus that has the functions of the scanner 1 other than a document reading function, that is, a reader 20, which will be described below. Consequently, although the scanner 1 has the document reading function, the scanner 1 can be regarded as a document feeder from the viewpoint of document feeding.

On the downstream of the feed roller 14 and the separation roller 15, a transport roller pair 16 is disposed, and on the downstream of the rollers, the reader 20 that functions as a reading device for reading images. On the downstream of the reader 20, a discharge roller pair 17 is disposed. The transport roller pair 16 includes a transport driving roller 16*a* that is driven by a transport motor 53 (see FIG. 3) and a transport driven roller 16*b* that is driven to rotate. A document that is nipped by the feed roller 14 and the separation roller 15 is fed downstream, is nipped by the transport roller pair 16, and is transported to a position at which the document faces an upper sensor unit 20A and a lower sensor unit 20B, which are disposed on the downstream of the transport roller pair 16.

The reader 20 includes the upper sensor unit 20A and the lower sensor unit 20B. The upper sensor unit 20A is disposed above a document feeding path, and the lower sensor unit 20B is disposed below the document feeding path. Each of the upper sensor unit 20A and the lower sensor unit 20B comprises a contact image sensor (CIS) module (CISM). The upper sensor unit 20A, which is disposed above the document feeding path, reads an upper surface of a document, and the lower sensor unit 20B, which is disposed below the document feeding path, reads a lower surface of the document.

After an image on at least one of the upper surface and the lower surface of a document has been scanned in the reader 20, the document is nipped by the discharge roller pair 17 that is disposed on the downstream of the reader 20 and is discharged from a discharge slot 18. The discharge roller pair 17 includes a discharge driving roller 17*a* that is driven to rotate by the transport motor 53 (see FIG. 3) and a discharge driven roller 17*b* that is driven to rotate.

Figure 3:
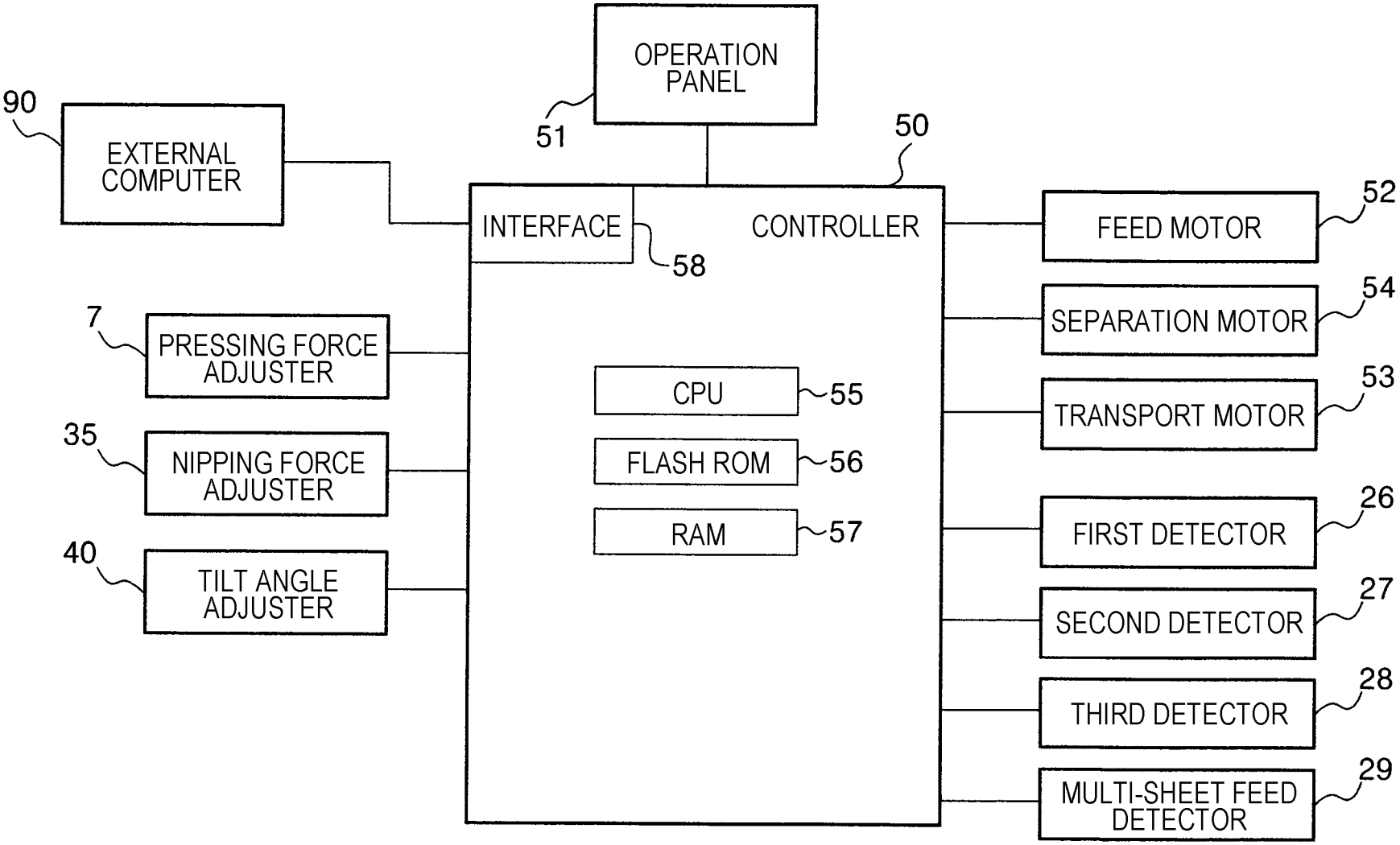
FIG. 3 is a block diagram of a control system in a scanner according to an embodiment of the present disclosure.

Hereinafter, a control system in the scanner 1 will be described with reference to FIG. 3 and as needed, FIG. 1. The controller 50 controls feeding, transporting, discharging, and reading of a document, and performs various kinds of control of the scanner 1. To the controller 50, signals are input through an operation panel 51, and from the controller 50, signals for display on the operation panel 51, more specifically, signals for implementing a user interface (UI) are sent to the operation panel 51.

The operation panel 51 according to the embodiment is a touch panel through which both of a displaying operation and an inputting operation can be performed. The operation panel 51 functions as an operation section for performing various operations and as a display section for displaying various kinds of information. The controller 50 controls the feed motor 52, the transport motor 53, and the separation motor 54. Each of the motors according to the embodiment is a direct current (DC) motor. To the controller 50, read data is input from the reader 20, and from the controller 50, signals for controlling the reader 20 are sent to the reader 20. To the controller 50, signals from a first detector 26, a second detector 27, a third detector 28, and a multi-sheet feed detector 29 are also input. In addition, to the controller 50, detection values from rotary encoders (not illustrated) that are disposed to the feed motor 52, the transport motor 53, and the separation motor 54 respectively are input, and based on the detection values, the controller 50 can grasp amounts of rotation of the respective motors.

The controller 50 includes a central processing unit (CPU) 55, a flash read-only memory (ROM) 56, and a random access memory (RAM) 57. The CPU 55 performs various arithmetic processing in accordance with a program stored in the flash ROM 56 and performs overall operational control of the scanner 1. The flash ROM 56, which is an example storage device, is a readable and writable nonvolatile memory, and stores various control programs, parameters, and the like necessary for document feeding control and document reading. Various kinds of setting information input by a user via the operation panel 51 is also stored in the flash ROM 56. In the RAM 57, which is an example storage device, various kinds of information is temporarily stored. The controller 50 includes an interface 58, and through the interface 58, communicates with an external computer 90.

Now, detectors that are disposed in the document transport path will be described mainly with reference to FIG. 1. The first detector 26 is disposed on the upstream of the feed roller 14, and more specifically, in the document feeding direction, disposed at a position between the feed roller 13 and the feed roller 14 and close to the feed roller 14. The controller 50 receives a signal from the first detector 26 and using the signal, detects passage of a leading edge and a trailing edge of a document at the position where the first detector 26 is disposed. The second detector 27 is disposed on the downstream of the feed roller 14 in the document feeding direction, and more specifically, disposed at a position between the feed roller 14 and the transport roller pair 16 and close to the feed roller 14. The controller 50 receives a signal from the second detector 27 and using the signal, detects passage of a leading edge and a trailing edge of a document at the position where the second detector 27 is disposed.

The third detector 28 is disposed at a position between the transport roller pair 16 and the reader 20 in the document feeding direction. The controller 50 receives a signal from the third detector 28 and using the signal, detects passage of a leading edge and a trailing edge of a document at the position where the third detector 28 is disposed. It should be noted that each of the first detector 26, the second detector 27, and the third detector 28 may be a non-contact sensor or a contact sensor.

The multi-sheet feed detector 29 is disposed between the feed roller 14 and the transport roller pair 16, and includes an ultrasonic transmitter and an ultrasonic receiver that face each other across the document feeding path. The controller 50 detects multi-sheet feeding of documents using a signal transmitted from the multi-sheet feed detector 29.

Figure 4:
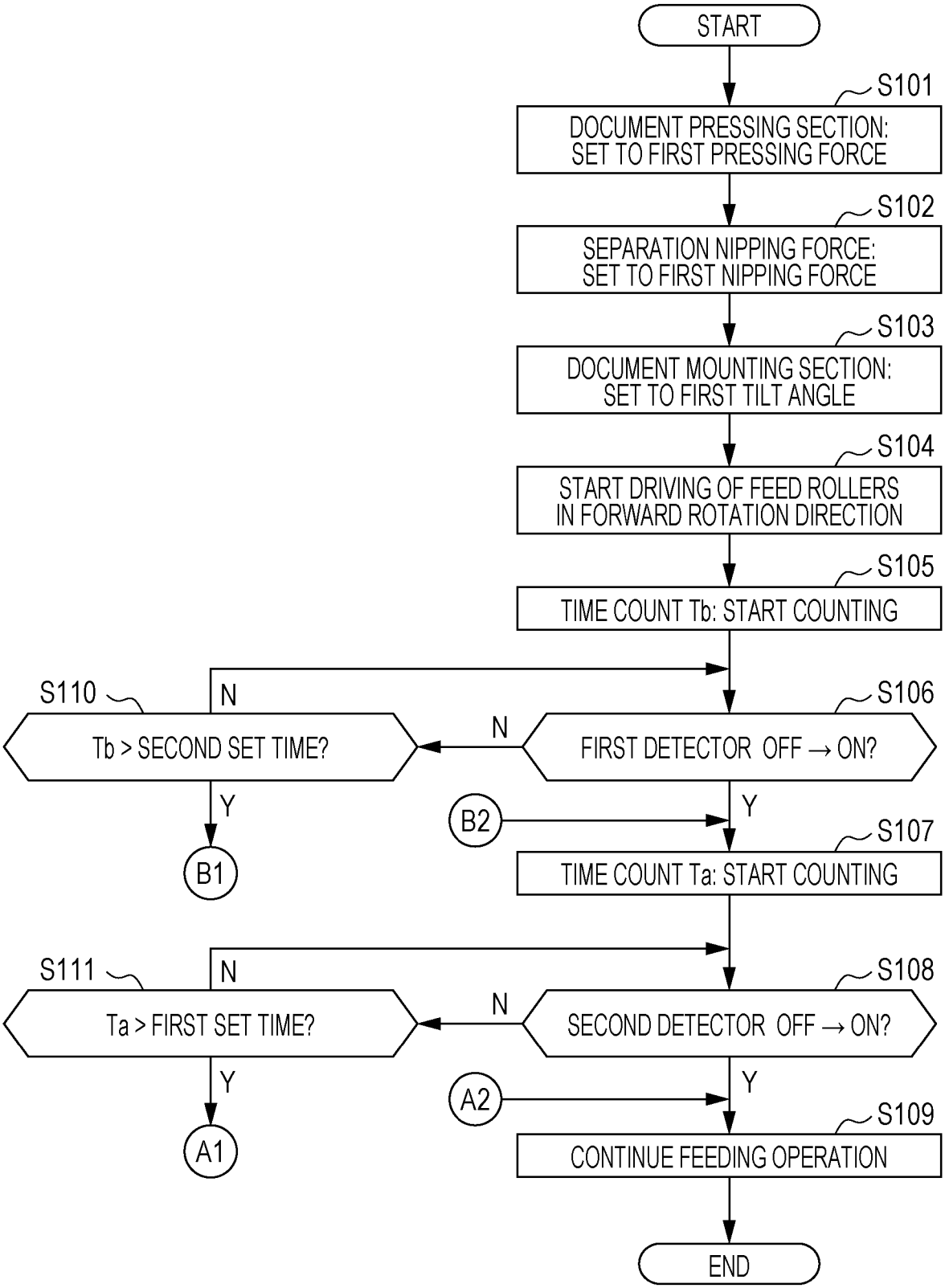
FIG. 4 is a flowchart illustrating a flow of document feeding control processing performed by a controller.

Hereinafter, control processing to be performed by the controller 50 in document feeding will be described mainly with reference to FIG. 4 and subsequent drawings. In FIG. 4, in response to receiving a feeding start instruction, the controller 50 sets a pressing force to be produced by the document pressing section 6 to a first pressing force (step S101). Then, the controller 50 sets a nipping force for nipping a document with the separation roller 15 and the feed roller 14 to a first nipping force (step S102). In the following description, the nipping force is referred to as "separation nipping force". The controller 50 sets a tilt angle of the document mounting section 5 to a first tilt angle (step S103). The first tilt angle according to the embodiment is zero degrees, and at the angle, the document mounting section 5 is set to a horizontal position.

Then, the controller 50 starts driving of the feed roller 13 and the feed roller 14 in the forward rotation direction (step S104), and at the same time, starts time counting of time count Tb (step S105). The controller 50 monitors a change in a detection signal from the first detector 26 from OFF, that is, a state in which no document exists, to ON, that is, a state in which a document exists (step S106). As a result of the monitoring, when the time count Tb exceeds a predetermined second set time before the detection signal from the first detector 26 changes from OFF to ON (Yes in step S110), the process proceeds to B1 in the flowchart illustrated in FIG. 5. The second set time can be obtained by experiment in advance, and may be set to a time with a certain margin added to an estimated time when a document is properly fed.

Figure 5:
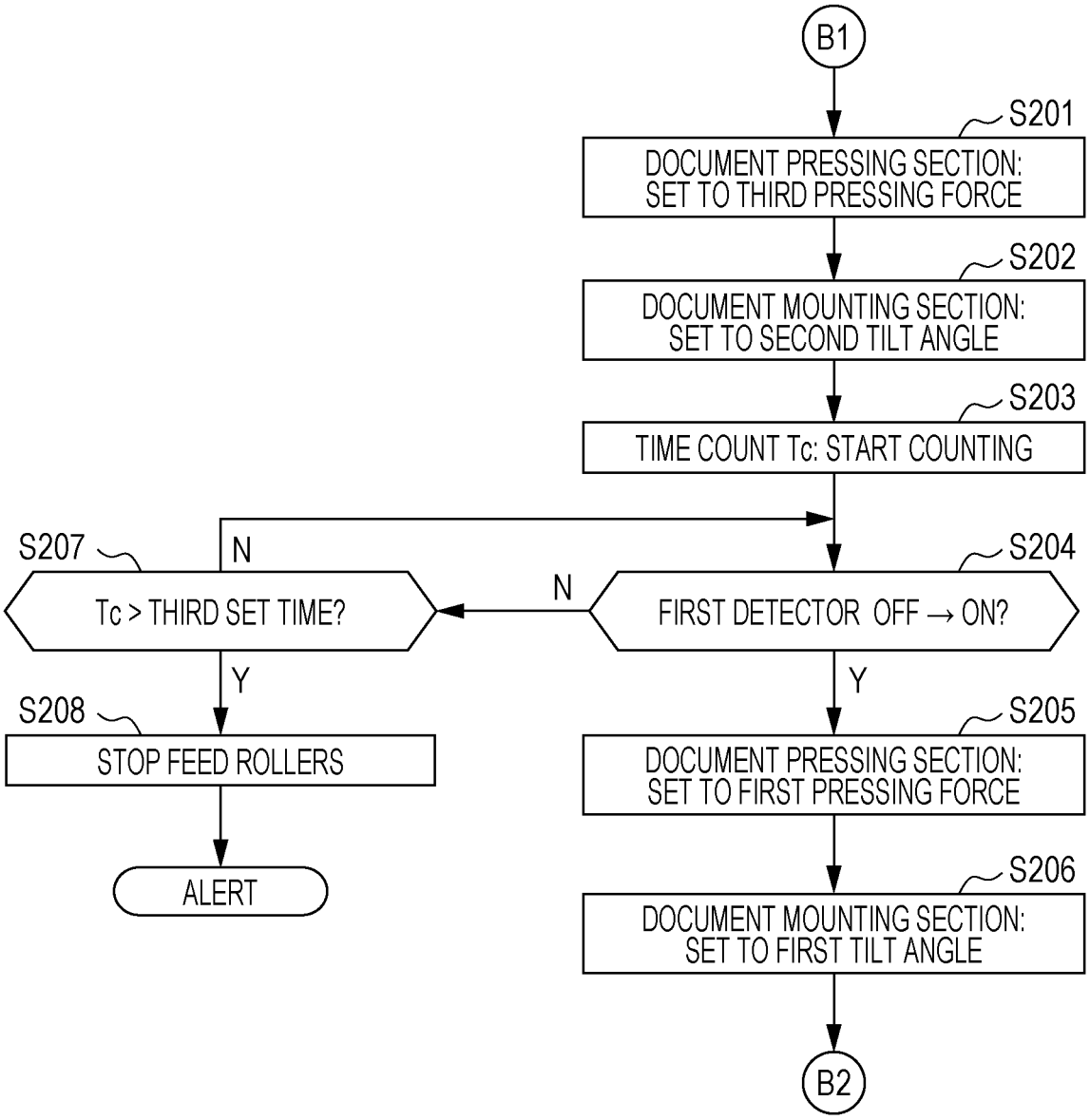
FIG. 5 is a flowchart illustrating a flow of document feeding control processing performed by a controller.

In FIG. 5, first, the controller 50 sets the pressing force of the document pressing section 6 to a third pressing force that is larger than the first pressing force (step S201). Then, the controller 50 sets the tilt angle of the document mounting section 5 to a second tilt angle that is larger than the first tilt angle (step S202). Then, the controller 50 starts time counting of a time count Tc (step S203). The controller 50 continues the forward rotation of the feed roller 13. It should be noted that in the processing in step S201 and S202, the forward rotation of the feed roller 13 may be performed without interruption, or may be temporarily stopped. By setting the pressing force of the document pressing section 6 to the third pressing force that is larger than the first pressing force, the document feeding force of the feed roller 13 can be increased. In addition, by setting the tilt angle of the document mounting section 5 to the second tilt angle that is larger than the first tilt angle, a transport load that acts on the documents mounted on the document mounting section 5 can be reduced. With this control, it can be expected that the leading edge of the document reaches the document detection position of the first detector 26.

The controller 50 monitors a change in the detection signal from the first detector 26 from OFF, that is, a state in which no document exists, to ON, that is, a state in which a document exists (step S204). As a result of the monitoring, when the time count Tc exceeds a predetermined third set time before the detection signal from the first detector 26 changes from OFF to ON (Yes in step S207), the controller 50 stops driving of the feed roller 13 and the feed roller 14 (step S208), and causes the operation panel 51 to issue an alert that indicates that the document is jammed.

Before the time count Tc exceeds the predetermined third set time (No in step S207), when the detection signal from the first detector 26 is changed from OFF, that is, a state in which no document exists, to ON, that is, a state in which a document exists (Yes in step S204), the controller 50 sets the pressing force of the document pressing section 6 to the first pressing force (step S205). At the same time, the controller 50 sets the tilt angle of the document mounting section 5 from the second tilt angle to the first tilt angle (step S206). Then, the process proceeds to B2 in the flowchart illustrated in FIG. 4, and the controller 50 performs the processing from step S107. As described above, after the controller 50 sets the pressing force of the document pressing section 6 to the third pressing force, when the first detector 26 detects a passage of a leading edge of a document within the predetermined third set time, the controller 50 changes the pressing force from the third pressing force to the first pressing force, and thus multi-sheet feeding of the documents due to an excessive pressing force can be prevented or reduced. In addition, after the controller 50 sets the tilt angle of the document mounting section 5 to the second tilt angle, when the first detector 26 detects a passage of a leading edge of a document within the predetermined third set time, the controller 50 changes the tilt angle from the second tilt angle to the first tilt angle, and thus multi-sheet feeding of the documents can be prevented or reduced.

Returning to FIG. 4, before the time count Tb exceeds the predetermined second set time (No in step S110), when the detection signal from the first detector 26 is changed from OFF, that is, a state in which no document exists, to ON, that is, a state in which a document exists (Yes in step S106), or when the process proceeds from step S206 in FIG. 5, the controller 50 starts time counting of the time count Ta (step S107).

Then, the controller 50 monitors a change in a detection signal from the second detector 27 from OFF, that is, a state in which no document exists, to ON, that is, a state in which a document exists (step S108). As a result of the monitoring, when the time count Ta exceeds a predetermined first set time before the detection signal from the second detector 27 changes from OFF to ON (Yes in step S111), the process proceeds to A1 in the flowchart illustrated in FIG. 6. The first set time can be obtained by experiment in advance, and may be set to a time with a certain margin added to an estimated time when a document is properly fed.

Figure 6:
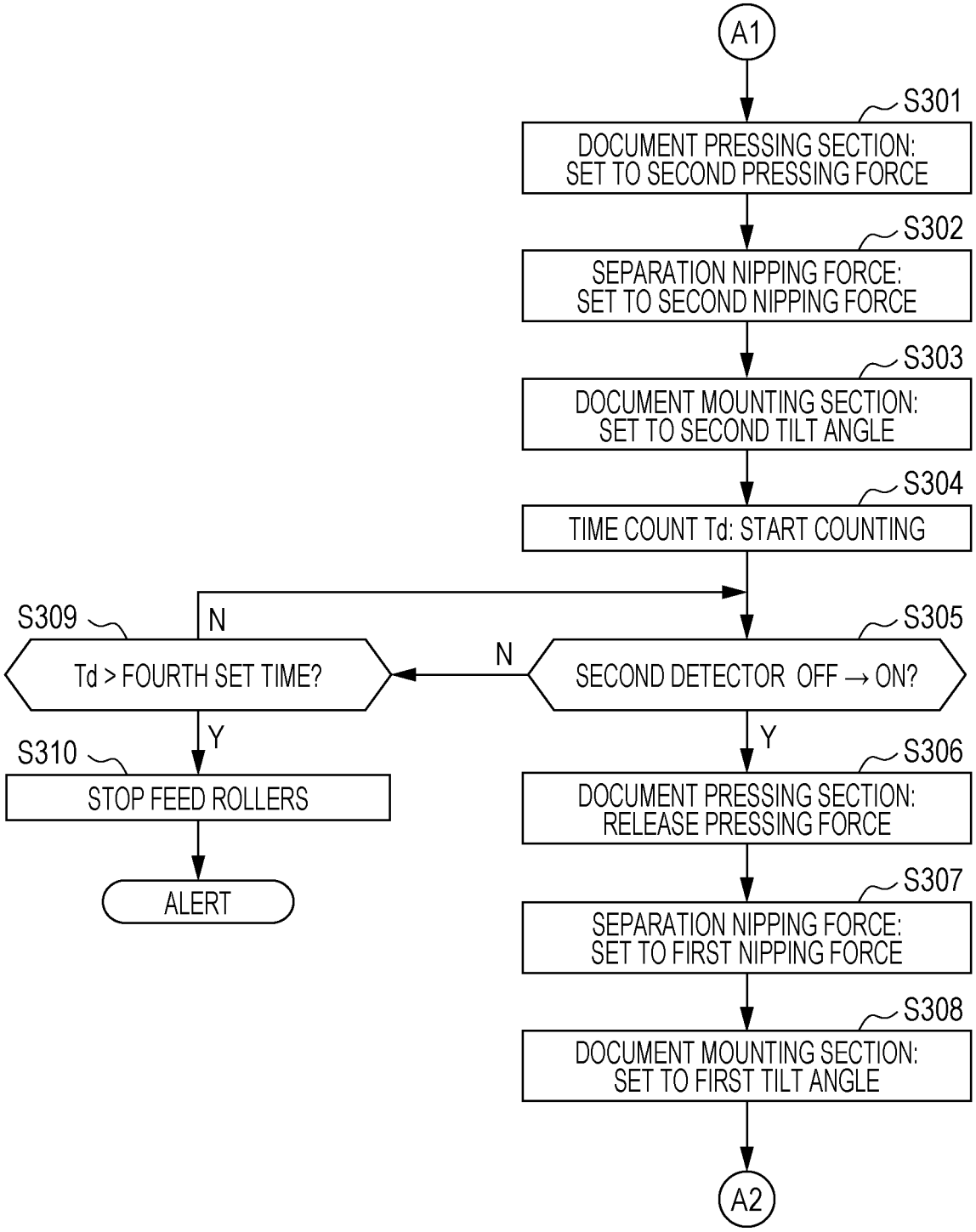
FIG. 6 is a flowchart illustrating a flow of document feeding control processing performed by a controller.

In FIG. 6, first, the controller 50 sets the pressing force of the document pressing section 6 to a second pressing force that is larger than the first pressing force (step S301). Then the controller 50 sets a separation nipping force to a second nipping force that is greater than or equal to first nipping force (step S302). Then, the controller 50 sets the tilt angle of the document mounting section 5 to the second tilt angle that is larger than the first tilt angle (step S303). At the same time, the controller 50 starts time counting of a time count Td (step S304). The controller 50 continues the forward rotation of the feed roller 13. It should be noted that in the processing in step S301, S302, and S303, the forward rotation of the feed roller 13 may be performed without interruption, or may be temporarily stopped.

By setting the pressing force of the document pressing section 6 to the second pressing force that is larger than the first pressing force, a decrease in the document feeding force with the feed roller 13 can be prevented or reduced. In addition, the controller 50 sets the separation nipping force to the second nipping force that is greater than or equal to first nipping force, the document feeding force with the separation roller 15 and the feed roller 14 can be increased. In addition, by setting the tilt angle of the document mounting section 5 to the second tilt angle that is larger than the first tilt angle, a transport load that acts on the documents mounted on the document mounting section 5 can be reduced. With this control, it can be expected that the leading edge of the document reaches the document detection position of the second detector 27. It should be noted that the second pressing force may be greater than or equal to the first pressing force. Accordingly, the second pressing force may be equal to the first pressing force. The second pressing force may be equal to the third pressing force (step S201 in FIG. 5), or may be smaller than the third pressing force, or may be larger than the third pressing force.

Them, the controller 50 monitors a change in the detection signal from the second detector 27 from OFF, that is, a state in which no document exists, to ON, that is, a state in which a document exists (step S305). As a result of the monitoring, when the time count Td exceeds a predetermined fourth set time before the detection signal from the second detector 27 changes from OFF to ON (Yes in step S309), the controller 50 stops driving of the feed roller 13 and the feed roller 14 (step S310), and causes the operation panel 51 to display an alert that indicates that the document is jammed.

Before the time count Td exceeds the predetermined fourth set time (No in step S309), when the detection signal from the second detector 27 is changed from OFF, that is, a state in which no document exists, to ON, that is, a state in which a document exists (Yes in step S305), the controller 50 releases the pressing force of the document pressing section 6 (step S306). Then, the controller 50 resets the separation nipping force to the first nipping force (step S307). Then, the controller 50 resets the tilt angle of the document mounting section 5 to the first tilt angle (step S308). As described above, after the controller 50 sets the pressing force of the document pressing section 6 to the second pressing force, when the second detector 27 detects a passage of a leading edge of a document within the predetermined fourth set time, the controller 50 releases the pressing of the document by the document pressing section 6, and thus multi-sheet feeding of the documents can be prevented or reduced. In addition, after the controller 50 sets the tilt angle of the document mounting section 5 to the second tilt angle, when the second detector 27 detects a passage of a leading edge of a document within the predetermined fourth set time, the controller 50 changes the tilt angle from the second tilt angle to the first tilt angle, and thus multi-sheet feeding of the documents can be prevented or reduced. Then, the process proceeds to A2 in the flowchart illustrated in FIG. 4, and the controller 50 performs the processing from step S109.

Returning to FIG. 4, before the time count Ta exceeds the predetermined first set time (No in step S111), when the detection signal from the second detector 27 is changed from OFF, that is, a state in which no document exists, to ON, that is, a state in which a document exists (Yes in step S108), or when the process proceeds from step S308 in FIG. 6, the controller 50 continues the subsequent feeding operation (step S109).

Before the detection signal from the third detector 28 is changed from OFF, that is, a state in which no document exists, to ON, that is, a state in which a document exists, when the multi-sheet feed detector 29 detects multi-sheet feeding of documents, the controller 50 may drive the feed roller 14, the separation roller 15, and the feed roller 13 in the reverse direction by a predetermined amount to move upstream the multi-fed documents. The operation of moving the multi-fed documents to the upstream may be performed, for example, by providing the space regulating section 10 in advance such that the space regulating section 10 can change its position along the feeding direction, and then changing the position of the space regulating section 10 to the upstream. With this structure, the multi-fed documents can be effectively moved to the upstream. A mechanism for operating the space regulating section 10 may include a motor and a rack-and-pinion mechanism that is driven by the motor.

It is to be understood that the present disclosure is not limited to the above-described embodiment, various modifications can be made within the scope of the following claims, and these modifications are included within the scope of the present disclosure. For example, as illustrated in FIG. 3, this embodiment includes three adjusters, that is, the pressing force adjuster 7, the nipping force adjuster 35, and the tilt angle adjuster 40; however, at least one of the pressing force adjuster 7 and the tilt angle adjuster 40 may be provided. In addition, only one of the processes in step S201 and step S202 illustrated in FIG. 5 may be performed. In such a case, the processes in step S205 or step S206 may be omitted as appropriate. Furthermore, in the processes in steps S301, S302, and S303 in FIG. 6, only one of the processes in step S301 and step S303 may be performed, or the process in step S302 may be omitted. In such a case, the processes in step S306, step S307, or step S308 may be omitted as appropriate.

For example, when Yes in step S106 in FIG. 4, that is, after the first detector 26 detects a leading edge of a document, the pressing force of the document pressing section 6 may be changed to a pressing force that is smaller than the first pressing force, and monitoring of the detection signal from the second detector 27 (step S108) may be performed. In the above-described embodiment, the nipping force for nipping a document with the separation roller 15 and the feed roller 14 is increased to increase the document feeding force with the separation roller 15 and the feed roller 14. Alternatively, or in addition to this, the rotation speed of the feed roller 14 may be increased to increase the document feeding force. In the above-described embodiment, the tilt angle of the document mounting section 5 is increased to solve the problem that no document is fed. Alternatively, or in addition to this, the feed roller 13 may be provided such that an amount of protrusion of the feed roller 13 from the document mounting section 5 can be adjusted, and then, the amount of protrusion may be increased.

What is claimed is:

1. A media feeding apparatus comprising:

a media mounting section on which a plurality of media sheets to be fed are to be mounted;

a first feed roller disposed at a position where the first feed roller faces a lowermost media sheet of the media sheets mounted on the media mounting section, the first feed roller being configured to apply a feeding force to the media sheets;

a media pressing arm configured to press the media sheets against the first feed roller;

a pressing force adjuster comprising an eccentric cam configured to adjust a pressing force of the media pressing arm for pressing the media sheets against the first feed roller;

a second feed roller disposed downstream of the first feed roller in a media feeding direction, the second feed roller being configured to feed the media sheets fed by the first feed roller in the media feeding direction;

a separation roller configured to nip and separate the media sheets with the second feed roller between the separation roller and the second feed roller;

a first sensor disposed upstream of the second feed roller in the media feeding direction, the first sensor being configured to detect a passage of the lowermost media sheet of the media sheets;

a second sensor disposed downstream of the second feed roller in the media feeding direction, the second sensor being configured to detect a passage of the lowermost media sheet of the media sheets; and a controller configured to control the pressing force adjuster and the feeding of the media sheets based on results of the detection by the first sensor and the second sensor, wherein the controller sets the pressing force of the media pressing arm to a first pressing force and controls a motor to drive the first feed roller and the second feed roller in a forward rotation direction, and after the first feed roller and the second feed roller start being driven, and when the first sensor detects a passage of a leading edge of the lowermost media sheet of the media sheets, the controller starts a first timer setting a predetermined first set time, in a first case in which the first sensor detects a passage of a leading edge of the lowermost media sheet of the media sheets and the second sensor detects no passage of the leading edge of the lowermost media sheet of the media sheets after the predetermined first set time has passed, the controller continues the rotation of the first feed roller and the second feed roller with a second pressing force of the media pressing arm greater than or equal to the first pressing force.

2. The media feeding apparatus according to claim 1, further comprising:

a nipping force adjuster comprising a second eccentric cam configured to adjust a nipping force for nipping the media sheets between the separation roller and the second feed roller, wherein the controller controls the nipping force adjuster, and the controller, in the first case, sets the nipping force to a second nipping force greater than a first nipping force, and continues the rotation of the first feed roller and the second feed roller.

3. The media feeding apparatus according to claim 1, further comprising:

a tilt angle adjuster comprising a motor configured to adjust a tilt angle of the media mounting section, wherein the controller controls the tilt angle adjuster, the controller sets the tilt angle of the media mounting section to a first tilt angle and drives the first feed roller and the second feed roller in the forward rotation direction, and the controller, in the first case, sets the tilt angle of the media mounting section to a second tilt angle greater than the first tilt angle, and continues the rotation of the first feed roller and the second feed roller.

4. The media feeding apparatus according to claim 2, further comprising:

a tilt angle adjuster comprising a motor configured to adjust a tilt angle of the media mounting section, wherein the controller controls the tilt angle adjuster, the controller sets the tilt angle of the media mounting section to a first tilt angle and drives the first feed roller and the second feed roller in the forward rotation direction, and the controller, in the first case, sets the tilt angle of the media mounting section to a second tilt angle greater than the first tilt angle, and continues the rotation of the first feed roller and the second feed roller.

5. The media feeding apparatus according to claim 2, wherein the controller, in the first case, increases a rotation speed of the second feed roller.

6. The media feeding apparatus according to claim 1, further comprising:

a regulator disposed on the downstream of the media pressing arm in the media feeding direction, the regulator being configured to regulate a number of media sheets to be fed into a nip portion between the second feed roller and the separation roller, and a multi-sheet feed sensor configured to detect multi-sheet feeding of the media sheets fed by the second feed roller, wherein the controller controls the regulator, and the controller, when the multi-sheet feed sensor detects multi-sheet feeding, changes the position of the regulator to the upstream.

7. An image reading apparatus comprising:

an image reading device configured to read a surface of a media sheet; and the media feeding apparatus according to claim 1.

8. The media feeding apparatus according to claim 1, wherein the pressing force of the media pressing arm remains at the first pressing force of the media pressing arm while the time of the first timer is elapsing.

9. The media feeding apparatus according to claim 1, wherein when the first feed roller and the second feed roller start being driven, the controller starts a second timer setting a predetermined second set time, and when the first sensor detects a passage of a leading edge of the lowermost media sheet of the media sheets within the predetermined second set time, the controller starts the first timer setting the predetermined first set time.

10. A media feeding apparatus comprising:

a media mounting section on which a plurality of media sheets to be fed are to be mounted;

a first feed roller disposed at a position where the first feed roller faces a lowermost media sheet of the media sheets mounted on the media mounting section, the first feed roller being configured to apply a feeding force to the media sheets;

a media pressing arm configured to press the media sheets against the first feed roller;

a pressing force adjuster comprising an eccentric cam configured to adjust a pressing force of the media pressing arm for pressing the media sheets against the first feed roller;

a second feed roller disposed downstream of the first feed roller in a media feeding direction, the second feed roller being configured to feed the media sheets fed by the first feed roller in the media feeding direction;

a separation roller configured to nip and separate the media sheets with the second feed roller between the separation roller and the second feed roller;

a first sensor disposed upstream of the second feed roller in the media feeding direction, the first sensor being configured to detect a passage of the lowermost media sheet of the media sheets;

a second sensor disposed downstream of the second feed roller in the media feeding direction, the second sensor being configured to detect a passage of the lowermost media sheet of the media sheets; and a controller configured to control the pressing force adjuster and the feeding of the media sheets based on results of the detection by the first sensor and the second sensor, wherein the controller sets the pressing force of the media pressing arm to a first pressing force and controls a motor to drive the first feed roller and the second feed roller in a forward rotation direction, wherein in a first case in which the first sensor detects a passage of a leading edge of the lowermost media sheet of the media sheets and the second sensor detects no passage of the leading edge of the lowermost media sheet of the media sheets after a predetermined first set time has passed, the controller continues the rotation of the first feed roller and the second feed roller with a second pressing force of the media pressing arm greater than or equal to the first pressing force, and after the controller sets the pressing force of the media pressing arm to the first pressing force and drives the first feed roller in the forward rotation direction, when the first sensor detects no passage of the leading edge of the lowermost media sheet of the media sheets after a predetermined second set time has passed, the controller sets the pressing force of the media pressing arm to a third pressing force greater than the first pressing force, and continues the rotation of the first feed roller.

11. The media feeding apparatus according to claim 10, wherein after the controller sets the pressing force of the media pressing arm to the third pressing force, when the first sensor detects a passage of the leading edge of the lowermost media sheet of the media sheets within a predetermined third set time, the controller changes the pressing force from the third pressing force to the first pressing force, and when the first sensor detects no passage of the leading edge of the lowermost media sheet of the media sheets after the predetermined third set time has passed, the controller stops the first feed roller and the second feed roller and issues an alert.

12. An image reading apparatus comprising:

a reader an image reading device configured to read a surface of a media sheet; and the media feeding apparatus according to claim 10.

13. A media feeding apparatus comprising:

a media mounting section on which a plurality of media sheets to be fed are to be mounted;

a tilt angle adjuster comprising a motor configured to adjust a tilt angle of the media mounting section, a first feed roller disposed at a position where the first feed roller faces a lowermost media sheet of the media sheets mounted on the media mounting section, the first feed roller being configured to apply a feeding force to the media sheets;

a media pressing arm configured to press the media sheets against the first feed roller;

a second feed roller disposed on a downstream of the first feed roller in a media feeding direction, the second feed roller being configured to feed the media sheets fed by the first feed roller in the media feeding direction;

a separation roller configured to nip and separate the media sheets with the second feed roller between the separation roller and the second feed roller;

a first sensor disposed on an upstream of the second feed roller in the media feeding direction, the first sensor being configured to detect a passage of the lowermost media sheet of the media sheets;

a second sensor disposed on the downstream of the second feed roller in the media feeding direction, the second sensor being configured to detect a passage of the lowermost media sheet of the media sheets; and a controller configured to control the tilt angle adjuster and the feeding of the media sheets based on results of the detection by the first sensor and the second sensor, wherein the controller sets the tilt angle of the media mounting arm to a first tilt angle and controls a motor to drive the first feed roller and the second feed roller in a forward rotation direction, and in a first case in which the first sensor detects a passage of a leading edge of the lowermost media sheet of the media sheets and the second sensor detects no passage of the leading edge of the lowermost media sheet of the media sheets after predetermined first set time has passed, the controller sets the tilt angle of the media mounting section from the first tilt angle to a second tilt angle that is greater than the first tilt angle and continues the rotation of the first feed roller and the second feed roller.

14. An image reading apparatus comprising:

an image reading device configured to read a surface of a media sheet; and the media feeding apparatus according to claim 13.

* * * * *